United States Patent [19]

Perrone, Jr.

[11] 4,456,250

[45] Jun. 26, 1984

[54] BASEBALL TEACHING DEVICE

[76] Inventor: Mathew R. P. Perrone, Jr., 306 Rustic La., Algonuin, Ill. 60102

[21] Appl. No.: 335,856

[22] Filed: Dec. 30, 1981

[51] Int. Cl.[3] ..... A63B 69/40

[52] U.S. Cl. ..... 273/26 R

[58] Field of Search ..... 273/26 R, 26 E, 201, 273/203, 29 A, 33, 183 A, 186 C, 186 R, 192, 195 R

[56] References Cited

U.S. PATENT DOCUMENTS

| | | | |
|---|---|---|---|
| 1,542,514 | 6/1925 | Mahoney | 273/203 |
| 3,139,282 | 6/1964 | Lande | 273/26 R |
| 3,874,662 | 4/1975 | Harrington | 273/26 E |
| 4,227,691 | 10/1980 | Lefebver et al. | 273/26 R |

*Primary Examiner*—Richard C. Pinkham
*Assistant Examiner*—T. Brown
*Attorney, Agent, or Firm*—Mathew R. P. Perrone, Jr.

[57] ABSTRACT

A device for teaching a proper batting swing to a baseball or softball player has a base and a forward pole together with two rear poles secured to the base. The forward pole and two rear poles are adjustable in height. Each rear pole is adapted to support a lightweight ball and the forward pole is adapted to support a softball or baseball. The poles are positioned substantially at the same vertical height to define a plane in which a bat swung by a player must travel to contact all three balls placed in the poles.

5 Claims, 3 Drawing Figures

BASEBALL TEACHING DEVICE

BACKGROUND OF THE INVENTION

This invention relates to sports and more particularly to a device suitable for assisting in the teaching of a proper batting swing.

In the game of baseball, one of the most difficult techniques to teach a player is the proper swing with the bat. The proper swing with a bat, according to Ted Williams (who is a Baseball Hall of Fame member, an acknowledged batting expert and the last man to finish a baseball season with a batting average in excess of 0.400), is a level swing substantially parallel to the ground, but with a slight uppercut so that the first level portion of the swing is at one height and the second level portion of the swing is at a slightly higher level in relation to the ground. At the same time the bat remains substantially parallel to the ground. This concept is extremely difficult to explain and teach. It is, therefore, desirable to have a method or device which assists in the training of the appropriate swing.

Such a batting swing is difficult to teach because it must at times be coordinated with a pitched ball. The batter must learn to time his swing with the pitch while at the same time remembering the proper technique of the slight uppercut-type swing. If a device can be developed to teach the fundamentals of a slight uppercut swing, the situation in teaching can be greatly simplified.

Thus, it becomes desirable to develop a device to assist in teaching. Some devices, known as tees, exist to teach a batting swing. These tees, however, consist only of a base and a stand secured thereto for the purpose of holding a ball—whether it be a hard ball or a soft ball. Such a tee provides no indication whatever of whether the correct slight uppercut-type swing has been achieved. It is difficult to teach a slight uppercut-type swing with such a tee.

Thus, it becomes abundantly clear that a device is needed to assist in such teaching of the desired uppercut-type swing.

SUMMARY OF THE INVENTION

Therefore, it is an object of this invention to provide a device for teaching the proper batting swing.

A further object of the invention is to provide a device to teach an uppercut-type batting swing.

Still a further object of this invention is to provide a device for teaching an uppercut batting swing which indicates when the proper swing has been accomplished.

These and other objects of this invention are met by providing a ball tee including a base suitable for ground contact and having at least two and preferably three adjustable poles mounted thereon.

BRIEF DESCRIPTION OF THE DRAWING

Throughout the Figures of the drawing, the same number refers to the same part.

DESCRIPTION OF THE PREFERRED EMBODIMENTS

A tee for teaching a proper batting swing includes a base having at least two and preferably three adjustable poles secured thereto with each of the three poles being adjustable in height, to thereby provide for teaching of the proper level, but slightly uppercut swing with a baseball or softball bat.

Figure 1:
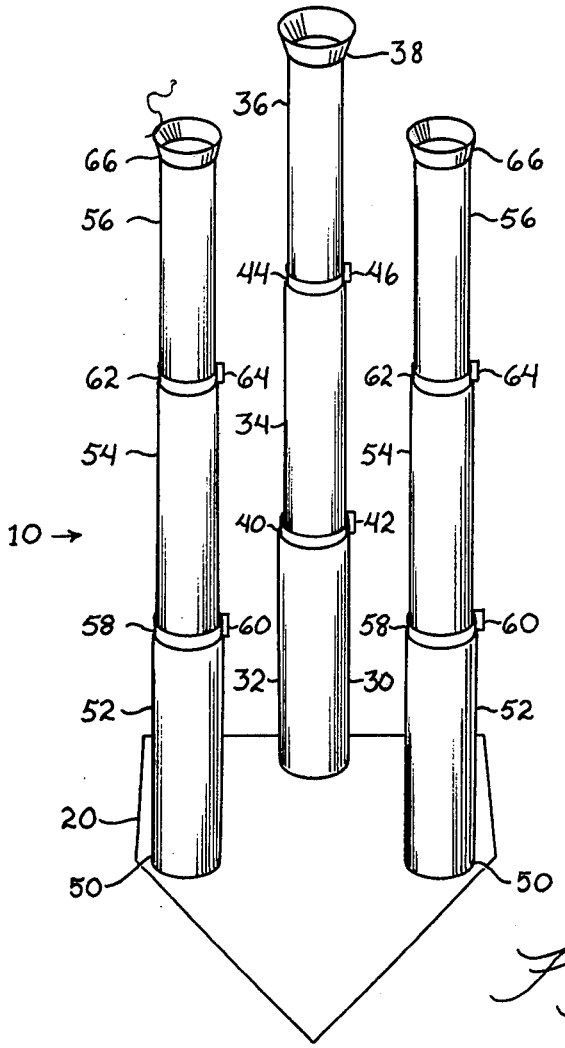
FIG. 1 is a perspective view of the batting tee 10 of this invention.

Referring now to FIG. 1, a perspective view of batting tee 10 is shown as having three adjustable poles thereon. Forward pole 30 is secured to base 20 at a forward portion thereof. It is forward pole 30 on which the ball desired to be hit is placed. The other two of the adjustable poles are rear poles 50 to the rear of a front pole and adjusted to be slightly lower in desired increments of height than the forward pole 30. A ball desired to be hit, such as a soft ball or a hard ball, is placed on forward pole 30. On the two rear poles 50, tennis balls or similar light-weight balls may be placed. The rear poles 50 being slightly lower than the forward pole 30 permit a slight uppercut swing to be indicated, because a proper slight uppercut swing can hit both tennis balls and contact the ball on front pole 30, which is higher than the rear balls on rear poles 50, to thereby indicate a proper uppercut-type swing.

Thus, a slight uppercut swing can be achieved. The three balls provide three points to determine a proper plane for the slight uppercut-type swing. Two poles may be used to teach the slight uppercut swing, but do not provide a proper indication of the plane in which to swing. So while two poles are operable, three are preferred. After the uppercut swing is achieved, the mechanics of meeting the pitched ball can be taught.

Forward pole 30 includes three nestable sections. The first section is forward pole base section 32. One end of forward pole base section 32 is secured to base 20. Forward pole base section 32 is of a hollow, elongated cylindrical shape, which permits forward pole base section 32 to receive therein forward pole middle section 34 as a first nestable section. Forward pole middle section 34 is also a hollow, elongated cylindrical shape and is capable of nesting within forward pole base section 32. Forward pole middle section 34 is capable of receiving therein forward pole top section 36 as a second nestable section. One end of forward pole top section 36 nests within forward pole middle section 34 and has a ball cup 38 for holding a ball to be hit glued or otherwise secured to the other end thereof.

Figure 2:
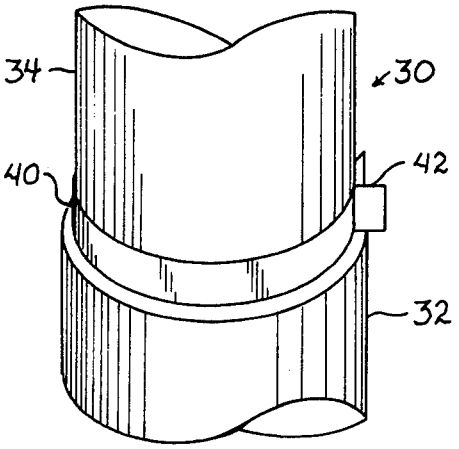
FIG. 2 is a close-up view forward middle pole clamp 40 as situated on forward pole 30.

As shown in FIG. 2, releasably secured to forward pole middle section 34 is middle clamp 40. Middle clamp 40 surrounds middle section 34 and has a hand-operated middle clamp release 42 thereon. Middle clamp 40 can be moved to any position on on forward middle section 34 by squeezing clamp release 42. When clamp release 42 is not squeezed, middle clamp 40 is locked in position on middle section 34. When middle clamp 40 is locked in position, forward pole middle section 34 is in a temporarily fixed position with respect to forward pole base section 32.

Similarly, releasably secured to forward pole top section 36 is forward pole top section clamp 44, which includes top section clamp release 46. Top section clamp release 46 functions in substantially the same manner as clamp release 42. The basic difference between middle clamp 40 and top section clamp 44 is in the diameter which cooperates with rear pole middle clamp 58 to adjust the rear poles 50 to a significant number of positions.

Rear pole top section 56 also nests with rear pole middle section 54 at one end and has rear ball holder 66 secured to the other end thereof by gluing or other suitable fashion.

Rear ball holders 66 and ball cup 38 provide structure for holding balls on the batting tee 10. The purpose of the balls is to indicate when the proper swing has been accomplished. The arc flight of the balls when hit is the preferred manner of so indicating. However, there are other ways of indicating the same information. For example, ball holders 66 or ball cup 38 may be replaced with an electronic device which emits one sound when properly struck, and another when improperly struck. Also ball holders 66 and ball cup 38 may be replaced by a mechanical indicating device. For example, rods may be secured to tee 10 in place of ballholders 66 or ball cup 38. Prior to swinging the rods are placed in an upright position. A proper swing can rotate the rods out of the upright position. To prepare for the next swing, the rods merely have to be set in the upright postions. It is also possible to change the indicators in many ways. For example, each indicator can be the female portion of a threaded relationship with the top of forward pole 30 or rear pole 50. The different indicators can also be mixed on the various poles as desired. Thus, there are many ways of indicating when the proper swing has been achieved.

It is possible to use only two sections in forward pole 30 and rear pole 50. However, since in certain leagues, the heights of the players can vary from one to two meters, it desired to use the three sections for the extra flexibility.

Figure 3:
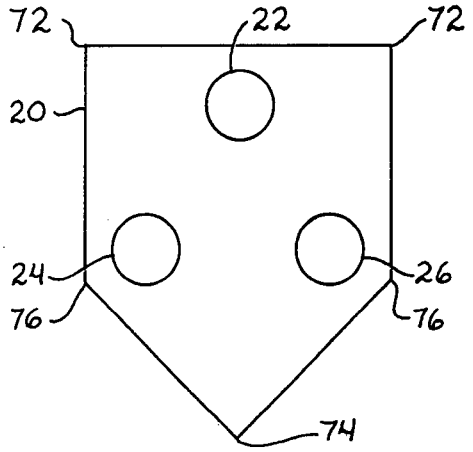
FIG. 3 is a top view of the base 20.

Referring now to FIG. 3 which depicts base 20, base 20 is shown in the standard home plate shape of a pentagon having two adjacent right angles 72 separated from a third right angle 74 by two equal obtuse angles 76. While different shapes are operable, the home plate shaped is used to acclimate the batter to game conditions. Forward pole aperture 22 is situated on base 20 between the two adjacent right angles 72 and receives one end of forward pole base section 32 in threaded relation wherein forward pole base section 32 is the male portion of male-female relationship.

Adjacent one obtuse angle 76 is first rear pole aperture 24. Adjacent the other obtuse angle 76 is second rear pole aperture 26. Each of first rear pole aperture 24 and second rear pole aperture 26 receive one end of each rear pole base 52 in threaded relation with each rear aperture, wherein the rear pole base is the male portion of a male-female relationship with base 20. Forward pole aperture 22 is basically the vertex of an isoceles triangle while first rear pole aperture 24 and second rear pole aperture 26 are the other vertices thereof.

Other variations may be used to achieve the desired results. Three sections are described herein because heights of the players involved can range from one to two meters, and three sections more easily give the desired flexibility. The sections may even be graduated to allow for precise height adjustments.

However, it clearly is possible to use two or more sections with the poles. Furthermore, other devices may be used to adjust the heights of the poles. For example a pawl and ratchet mechanism may be used to adjust the heights. A series of mating apertures in the pole sections combined with pins may also be used. The preferred method of adjusting heights as disclosed allows for the greatest flexibility.

The only real limitation on materials for the tee 10 of this invention is that the materials must be durable and capable of absorbing the stress of use in the outdoors and capable of absorbing blows from a bat in case of a missed swing without substantial damage to either the bat or to the tee 10. Thus the materials may be metal, synthetic resins, plastics or combinations thereof. The base 20 may be hollow and capable of being filled with sand or other suitable ballast to provide for simpler transportation. The base 20 may also be heavy enough for support in and of itself.

In view of this disclosure, a person having ordinary skill in this art can easily determine various modifications in this device. Accordingly, it is felt that such variations and modifications are covered hereunder.

What is claimed and sought to be secured by Letters Patent of the United States is:

1. A batting tee for a baseball or a softball suitable for teaching a player a proper level—with a slight uppercut—swing, said tee including a base means and three vertically extending adjustable pole means; wherein:

(a) said three adjustable pole means include a forward pole and two rear poles in a triangular relationship attached to said base means;

(b) said forward pole serves to hold a softball or baseball;

(c) said two rear poles serve to hold two lightweight balls as swing indicators;

(d) said forward pole and said rear poles have at least two sections and said two sections include a first nestable section and a base section to render said forward pole and said rear poles adjustable in height;

(e) said base section is secured at its lower end to said base and receives the lower end of said first nestable section at its upper end;

(f) a first nestable section clamp is positioned on said first nestable section to adjustably hold said first nestable section relative to said base section;

(g) a ball support means is secured to the upper end of said first nestable section and oppositely disposed from said base section;

(h) said rear poles are substantially equal in height and differ in height from said forward pole;

(i) said ball support means on said rear poles are capable of receiving said two lightweight balls;

(j) said ball support means on said forward pole is capable of receiving said softball or said baseball; and (k) the predetermined height of said rear poles and said forward pole combine to determine a plane in which a bat must travel to contact all three balls placed on said pole means.

2. The batting tee of claim 1 wherein said ball support is cup-shaped.

3. The batting tee of claim 2 wherein said base means is pentagonal in shape.

4. The batting tee of claim 3 wherein forward pole is substantially perpendicular to said base and said rear poles are substantially parallel to said forward pole.

5. The batting tee of claim 4 wherein said forward pole and said rear poles have three nestable sections.

* * * * *